US006942012B2

(12) United States Patent
Hauri et al.

(10) Patent No.: US 6,942,012 B2
(45) Date of Patent: Sep. 13, 2005

(54) CHILL TUBE FOR THE CONTINUOUS CASTING OF METALS

(75) Inventors: Roland Hauri, Wettswil (CH); Egon MacKowiak, Osnabruck (DE); Dietmar Kolbeck, Steinfeld (DE); Gerhard Hugenschütt, Belm (DE)

(73) Assignee: KM Eurpoa Metal AG, Osnabruck (DE)

( * ) Notice: Subject to any disclaimer, the term of this patent is extended or adjusted under 35 U.S.C. 154(b) by 12 days.

(21) Appl. No.: 10/819,637

(22) Filed: Apr. 7, 2004

(65) Prior Publication Data

US 2004/0188056 A1 Sep. 30, 2004

Related U.S. Application Data

(62) Division of application No. 10/301,102, filed on Nov. 21, 2002, now Pat. No. 6,736,202.

(30) Foreign Application Priority Data

Dec. 7, 2001 (DE) ..... 101 60 135

(51) Int. Cl.[7] ..... B22D 11/00
(52) U.S. Cl. ..... 164/418; 164/435; 164/443
(58) Field of Search ..... 164/418, 435, 164/443, 459, 485

(56) References Cited

U.S. PATENT DOCUMENTS 2,169,893 A 8/1939 Carmpton et al.
3,853,309 A 12/1974 Frederick
3,991,822 A 11/1976 Morris
4,088,295 A 5/1978 Medovar et al.
4,272,683 A 6/1981 Baatz et al.
5,314,008 A 5/1994 Garcia-Mallol
5,513,691 A * 5/1996 Langner et al. ..... 164/418
5,899,150 A 5/1999 Martin et al.
6,315,030 B1 11/2001 Poloni et al.
6,367,539 B1 4/2002 Poloni et al.
6,443,218 B1 * 9/2002 Hornschemeyer ..... 164/418
6,612,363 B1 * 9/2003 Lorento ..... 164/459

FOREIGN PATENT DOCUMENTS

GB 954 719 4/1964

* cited by examiner

*Primary Examiner*—Kiley S. Stoner
*Assistant Examiner*—Ing-Hour Lin
(74) *Attorney, Agent, or Firm*—Kenyon & Kenyon

(57) ABSTRACT

A chill tube (1) for the continuous casting of metals has a double T-shaped cross section in beam blank format. Inner contour (3) defining the cross section of the cast billet is cooled by cooling water, which is guided through cooling channels (4) in tube wall (2). Cooling channels (4) have a round cross section when manufactured. Inner contour (3) has rounded transitions (6) between wall sections (9) bordering a flange region (7) and a crosspiece region (8). The distance (A) between two cooling channels (4) adjacent to each other in transitions (6) is smaller than distance (B) in the remaining wall sections (9).

12 Claims, 2 Drawing Sheets

CHILL TUBE FOR THE CONTINUOUS CASTING OF METALS

RELATED APPLICATION

This application is a divisional of U.S. patent application Ser. No. 10/301,102, filed Nov. 21, 2002, and now issued as U.S. Pat. No. 6,736,202, which claims foreign benefits under 35 U.S.C. §119 of German Patent Application No. 101 60 135.2, filed Dec. 7, 2001.

BACKGROUND OF THE INVENTION

1. Field of the Invention

The invention relates generally to a chill tube for the continuous casting of metals. More specifically, the invention relates to a chill tube whose tube wall has an inner contour in beam blank format, having rounded transitions between the wall sections bordering on one side a flange region and on the other side a crosspiece region, the inner contour being able to be cooled indirectly by a cooling medium supplied from the outside and having cooling channels in the tube wall which extend in its longitudinal direction.

2. Description of Related Art

In the continuous casting of metals, in order to dissipate the heat that accrues, it is known that one may build a chill tube into a water-guiding jacket. In this connection one has to take care that, on account of the inner dimensions of the water-guiding jacket on the one hand, and the outer dimensions of the chill tube on the other hand, a specified gap is formed, from a thermal technology point of view, through which cooling water flows from bottom to top, which absorbs the accruing heat and carries it off. If a chill tube in beam blank shape is installed, the inner contour of the water-guiding jacket has also to correspond to the outer contour of such a shape.

Heat dissipation by the cooling water is largely determined by the speed of the water in the gap between the chill tube and the water-guiding jacket. However, with each recalibration of a chill tube, the gap becomes larger because of the erosion due to wear, and the inevitable reduction in the wall thickness of a chill tube caused thereby. Meanwhile, the enlargement of the water gap is connected with a reduction in the water speed, and consequently also with a reduction in the heat dissipation.

It is known from GB 954 719 that one can furnish chills, for the continuous casting of metals, with cooling bores which extend both in the longitudinal direction and in the transverse direction of the chill tube. However, in the case of chill tubes in beam blank format, the problem arises that the cooling bores transverse to the longitudinal extension can be applied to the chill tubes only with great effort. In addition, in the case of the special geometry of the beam blank format, extreme local heat stresses are created in the transitions between wall sections bordering, on the one side, a flange region and, on the other side, a crosspiece region. In the case of unfavorable geometrical relationships of the transitions, these local heat stresses lead to overheating of the chill tube, and to a drastic reduction in its service life.

SUMMARY OF THE INVENTION

It is an object of the invention to provide a chill tube, for the continuous casting of metals, which has an improved service life and in which local overheating is avoided.

These and other objects of the invention are achieved by a chill tube for the continuous casting of metals, whose tube wall (2) has an inner contour (3) in beam blank format, having rounded transitions (6) between the wall sections (9) bordering on one side a flange region (7) and on the other side a crosspiece region (8), the inner contour (3) being able to be cooled indirectly by a cooling medium (cooling water) supplied from the outside; and the cooling channels (4) being provided in the tube wall (2) which extend in its longitudinal direction, wherein the distance (A) between two cooling channels (4) which are adjacent to each other in transitions (6) is smaller than the distance (B) in the remaining wall sections (9).

In another embodiment, the cooling channels (4) are provided only in the rounded transitions (13), while the remaining wall sections (16) as well as the rounded transitions (13) are able to be cooled by a water guiding jacket adapted

BRIEF DESCRIPTION OF THE DRAWINGS

The present invention will be described in greater detail with reference to the following drawings wherein.

DETAILED DESCRIPTION OF THE INVENTION

Figure 1:
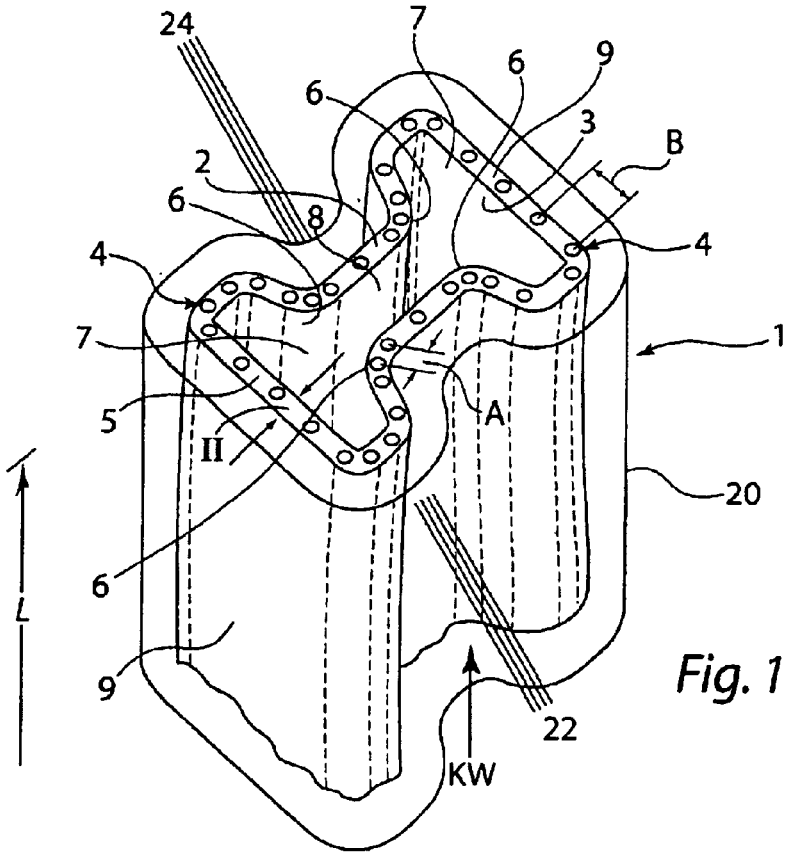
FIG. 1 shows the upper end section of a chill tube in beam blank format, in perspective.

In a first embodiment of the invention, the distance between two cooling channels adjacent to each other in the transitions is smaller than the distance between adjacent cooling channels in the remaining wall sections.

First of all, this has the advantage that a water-guiding jacket which has to be adapted to the outer contour of the chill tube may be omitted in principle. This clear reduction in manufacturing costs is particularly noticeable in the case of a chill tube in a beam blank format.

Because of the heat dissipation via the cooling channels in the wall of the tube, no further changing heat dissipation conditions are created. The number of recalibrations has no influence on the cooling efficiency.

The cooling channels may basically exit in all wall sections at the end faces of the tube wall. In these regions, for the purpose of problem-free mounting and secure sealing of a chill tube it is possible without problem, after the recalibration, also to perform welds, which are then simply reworked to the new measurement after the recalibration.

If the cooling channels are furnished with a round cross section, the further advantage is revealed, after bending a chill tube to a beam blank format, that in doing this, the cross sections of many of the cooling channels are also deformed to oval, namely in the sense that the surface areas in the direction of the casting channel increase in size, so that one may count on increased heat dissipation.

In another embodiment of the invention, it is possible to provide cooling channels only in the rounded transitions, while the remaining wall sections as well as the rounded transitions are able to be cooled by a water-guiding jacket adapted to the outer contour of the tube's wall. In this solution, not the entire tube wall is interspersed with cooling channels. Rather, cooling bores are present exclusively in those regions in which local overheating would lead to a reduction in the service life of the chill tube. By the combination of a water-guiding jacket with cooling channels inserted into the rounded transitions of the tube's wall, local overheating in the rounded transitions can be avoided, and the service life of the chill tube can be increased.

It is also possible to provide a water-guiding jacket, and at the same time to provide cooling bores, both in the rounded transitions and in the remaining wall sections of the tube's wall, the distance of two cooling channels which are adjacent in the transitions being shorter than the distance in the remaining wall sections.

The cooling channels provided in the transitions may extend from the upper end face of the tube's wall to about the middle height of the tube's wall. This takes care of a more intensive heat dissipation in wall sections which are thermally greatly stressed locally.

An optional feature is that in the outer contour of the tube wall, cooling medium supply lines and cooling medium drain lines connected to the cooling channels are provided. These are especially advantageously provided at the middle height region on the outer contour of the tube's wall. In order to form a cooling channel system, the cooling channels inserted from the direction of the end faces of the tube's wall are closed and connected to one another by overflow channels.

For cooling the chill tube, it is basically possible to connect the cooling medium supply lines and the cooling medium drain lines to a separate cooling circulation. However, advantageously, the cooling medium flowing between the tube's wall and the water-guiding jacket is also able to flow through the cooling channels, and take care of intensive heat dissipation in thermally more highly stressed regions. In order to facilitate the entry of the cooling medium from the gap between the water-guiding jacket and the tube's wall into the cooling channels, suitable guiding means can be provided on the outer contour of the tube's wall and/or the water-guiding jacket, which steer the flow pattern of the cooling medium into the cooling channels.

The features according to the invention become particularly advantageous in the case of a chill tube having a double T-shaped cross section.

The chill tube is preferably made of copper or a copper alloy.

Figure 2:
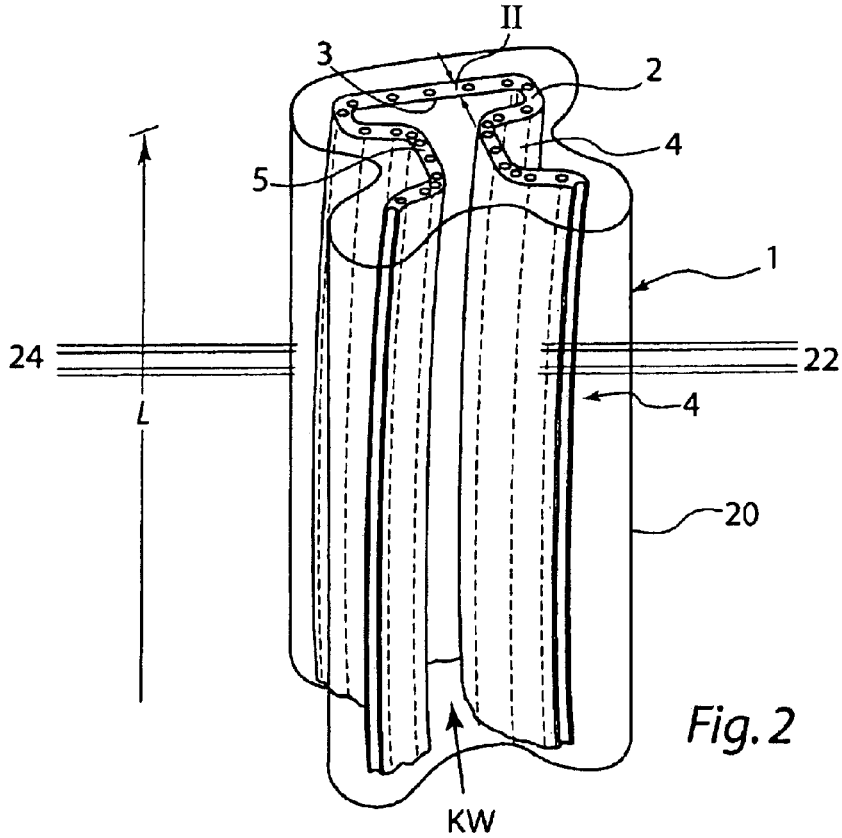
FIG. 2 shows the chill tube of FIG. 1 in a slightly elongated representation in a different perspective.

Referring to FIGS. 1 and 2, reference numeral 1 signifies a chill tube in beam blank format.

Chill tube 1 has a double T-shaped cross section having a thickness D of tube wall 2 which is constant over the entire circumference.

Inner contour 3 of chill tube 1 determines the cross section of the cast billet.

In order to remove the heat that accrues during casting, cooling channels 4 are inserted into the tube's wall 2, which extend over the entire length L of chill tube 1, and which, according to arrow KW are able to have cooling water applied to them from bottom to top. That means that cooling channels 4 end at the end faces 5 of tube wall 2, only one end face 5 being visible.

Cooling channels 4 are inserted into tube wall 2 by a drilling operation, that is, before chill tube 1 is bent. On account of the bending, cooling channels 4 can then be partially deformed into oval shapes in such a way that, in the direction towards inner contour 3, larger surface areas are formed, whereby heat dissipation is improved.

The special inner contour 3 of chill tube 1 has rounded transitions 6 between wall section 9 bordering, on the one side a flange region 7, and on the other side a crosspiece region 8. The distance A between two cooling channels 4 adjacent to each other in transitions 6 is smaller than distance B in the remaining wall section 9.

Whereas in the exemplary embodiments of FIG. 1 and 2 cooling channels 4 penetrate chill tube 1 over its entire length L, it is also conceivable that cooling channels 4 provided in transitions 6 might extend from upper end face 5 of tube wall 2 to about the middle height region of tube wall 2. In order to form a cooling circulation, these cooling channels 4 may be connected to one another at their upper end faces, and be supplied with a cooling medium at the middle height region of tube wall 2 via cooling medium supply lines and cooling medium drain lines.

In addition, chill tube 1 can be embedded in a water-guiding jacket adapted to outer contour 10 of tube wall 2, so that chill tube 1 is totally surrounded by a cooling gap that has a cooling medium flowing through it.

Figure 3:
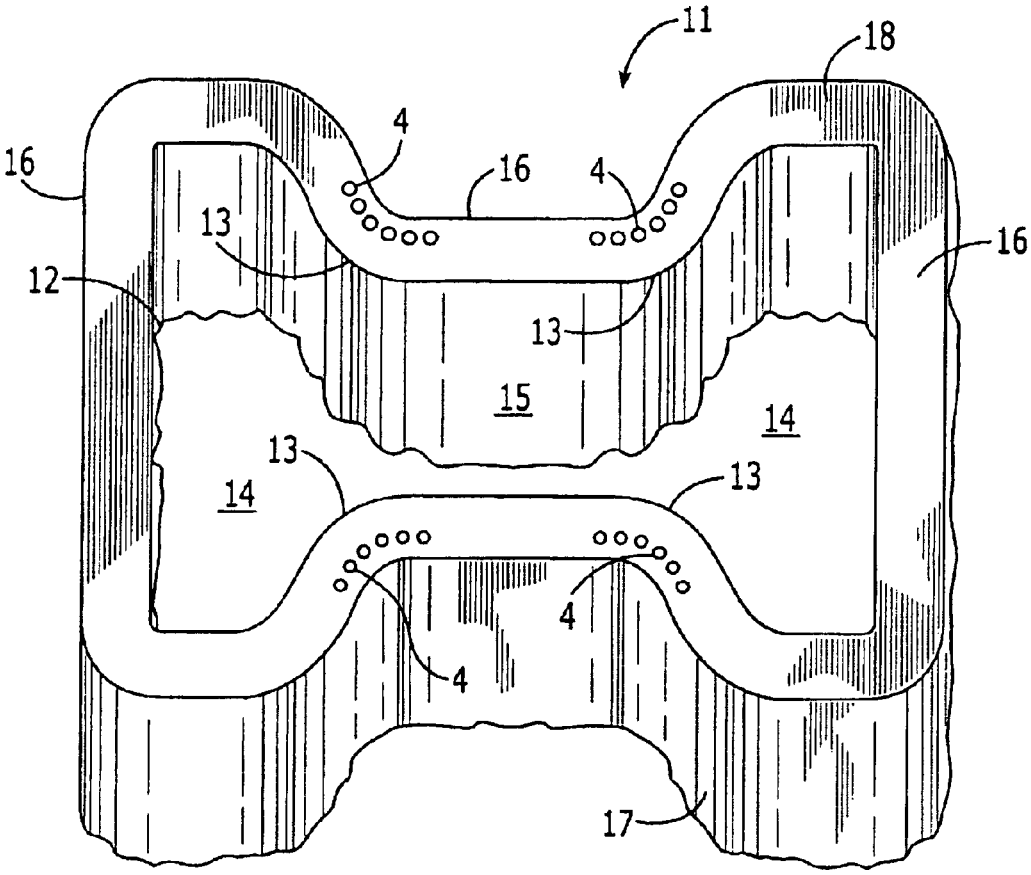
FIG. 3 shows the upper end section of a chill tube in beam blank format, according to a further specific embodiment.

In a somewhat different perspective, FIG. 3 shows another specific embodiment of a chill tube 11, having an interior contour 12, in beam blank format, also having rounded transitions 13 between wall sections 16 bordering on one side a flange region 14 and on the other side a crosspiece region 15. In this exemplary embodiment cooling bores 4 are present only in transition regions 13. The entire chill tube 11 is embedded, in a manner not shown in detail, in a water-guiding jacket adapted to outer contour 17 of tube wall 18, via which are cooled both the remaining wall sections 16 and transition regions 13 furnished with cooling bores 4.

What is claimed is:

1. A chill tube for the continuous casting of metals, comprising: a tube wall (2) having an inner contour (3) in beam blank format, the inner contour having rounded transitions (6) between wall sections (9) bordering on one side a flange region (7) and on the other side a crosspiece region (8) the inner contour (3) being able to be cooled indirectly by an externally supplied cooling medium; and cooling channels (4) provided in the tube wall (2) which extend in its longitudinal direction, wherein the distance (A) between two cooling channels (4) which are adjacent to each other in transitions (6) is smaller than the distance (B) in the remaining wall sections (9).

2. The chill tube according to claim 1, further comprising a water-guiding jacket adapted to the outer contour of the tube wall.

3. The chill tube according to claim 2, wherein the cooling channels (4) provided in the transitions extend from the upper end face (5) of the tube wall to approximately the middle height region of the tube wall.

4. The chill tube according to claim 2, wherein cooling medium supply lines and cooling medium drain lines connected to the cooling channels (4) are provided in the outer contour of the tube wall.

5. The chill tube according to claim 2, wherein the cooling channels (4) have flowing through them a cooling medium which flows between the tube wall and the water-guiding jacket.

6. The chill tube according to claim 2, wherein it has a double T-shaped cross section.

7. The chill tube according to claim 1, wherein cooling medium supply lines and cooling medium drain line connected to the cooling channels (4) are provided in the outer contour of the tube wall.

8. The chill tube according to claim 7, wherein the cooling medium supply lines and the cooling medium drain lines are provided in the middle height region of tube wall.

9. The chill tube according to claim 1, wherein the cooling channels (4) provided in the transitions extend from the upper end face (5) of the tube wall to approximately the middle height region of the tube wall.

10. The chill tube according to claim 9, wherein cooling medium supply lines and cooling medium drain lines connected to the cooling channels (4) are provided in the outer contour of the tube wall.

11. The chill tube according to claim 10, wherein the cooling medium supply lines and the cooling medium drain lines are provided in the middle height region of tube wall.

12. The chill tube according to claim 1, wherein it has a double T-shaped cross section.

* * * * *

UNITED STATES PATENT AND TRADEMARK OFFICE

CERTIFICATE OF CORRECTION

PATENT NO. : 6,942,012 B2
DATED : September 13, 2005
INVENTOR(S) : Hauri et al.

It is certified that error appears in the above-identified patent and that said Letters Patent is hereby corrected as shown below:

Title page,
Item [73], Assignee, should read -- KM Europa Metal AG, --.

Signed and Sealed this

Seventh Day of March, 2006

JON W. DUDAS
*Director of the United States Patent and Trademark Office*